US005472287A

United States Patent [19]

Hasegawa et al.

[11] Patent Number: 5,472,287

[45] Date of Patent: Dec. 5, 1995

[54] PRINTER WITH VALIDATION PAPER FEEDING MECHANISM

[75] Inventors: Kazumi Hasegawa, Tachikawa; Makoto Kawasaki, Tokorozawa, both of Japan

[73] Assignee: Citizen Watch Co., Ltd., Tokyo, Japan

[21] Appl. No.: 375,107

[22] Filed: Jan. 19, 1995

[30] Foreign Application Priority Data

Jan. 19, 1994 [JP] Japan ..... 6-017765
Jan. 19, 1994 [JP] Japan ..... 6-017766

[51] Int. Cl.[6] ..... B41J 11/50

[52] U.S. Cl. ..... 400/585; 400/605; 400/608.4; 226/4; 101/228

[58] Field of Search ..... 400/585, 605, 400/607, 607.3, 608.1, 608.2, 608.3, 608.4, 636; 101/228, 232; 226/34, 35, 36, 37, 49, 50, 51, 4; 271/314

[56] References Cited

U.S. PATENT DOCUMENTS

| | | | |
|---|---|---|---|
| 4,027,765 | 6/1977 | Crump et al. | 400/608.4 |
| 4,205,770 | 6/1980 | Wojdyla | 400/608.1 |
| 4,229,113 | 10/1980 | Anderson et al. | 400/605 |
| 4,403,878 | 9/1983 | Hosogaya | 400/585 |
| 4,439,051 | 3/1984 | Lawter | 400/605 |
| 5,139,353 | 8/1992 | Ota | 400/607 |
| 5,146,238 | 9/1992 | Numabe et al. | 400/585 |
| 5,149,217 | 9/1992 | Narita | 400/608.4 |
| 5,308,175 | 5/1994 | Ito | 400/605 |

FOREIGN PATENT DOCUMENTS 4-179563 6/1992 Japan .

*Primary Examiner*—Eugene H. Eickholt
*Attorney, Agent, or Firm*—Lowe, Price, LeBlanc & Becker

[57] ABSTRACT

A printer having a validation paper feeding mechanism in which the validation paper feed is controlled by a single solenoid and only the validation paper feed can be effected even when a cut or continuous paper is set. A ratchet wheel and a validation roller are mounted on the rotatable shaft via a one-way clutch. The one-way clutch selectively transmits a torque of the rotatable shaft to the validation roller in the direction of the validation paper feed. The validation roller has an arcuate circumferential surface for feeding the validation paper and a chord flat surface for inserting the validation paper. The armature is angularly moved between a first position where it engages the positioning projection of the ratchet wheel for determining an initial position of the validation roller and a second position where it engages the pawls of the ratchet wheel for stopping the validation roller at a plurality of predetermined positions.

5 Claims, 14 Drawing Sheets

PRINTER WITH VALIDATION PAPER FEEDING MECHANISM

BACKGROUND OF THE INVENTION

1. Field of the Invention

This invention relates to a printer equipped with a validation paper feeding mechanism, and more particularly to a printer having a standard paper feeding roller and a validation paper feeding roller, which are in contact with a friction roller.

2. Description of the Related Art

A printer for printing not only standard papers, i.e. continuous paper and cut paper, but also validation papers using a single print head is known from, for example, Japanese Patent Laid-Open Publication No. 4-179563(179563/1992). Validation papers are a kind of cut papers composed of a multiplicity of copy sheets which are generally regular in size.

In the printer disclosed in the above Japanese Patent Laid-Open Publication, a platen and a recording paper pressure roller are mounted on a swing arm which is angularly moved by a plunger-type solenoid to bring the platen and the recording paper pressure roller against and apart from the print head and a recording paper drive roller, which are arranged in confronting relationship with the swing arm. A recording paper path defined by the platen and the print head and by the recording paper pressure roller and the recording paper drive roller can be opened and closed. An upper part of the recording paper path serves as a common paper outlet port for the cut paper, continuous paper and validation paper, while a lower part of the recording paper path is divided into a cut paper path and a validation paper path. A continuous paper path communicates with a central portion of the recording paper path between the print head and the recording paper drive roller.

The paper feeding mechanism of this printer comprises the plunger-type solenoid, the swing arm on which the platen and the recording paper pressure roller are mounted, and the record paper drive roller disposed stationary.

For printing a validation paper, the paper is inserted into the recording paper path for validation paper from the paper outlet port at the upper part of recording paper path, with the recording paper path kept open by not energizing the plunger. Then, the plunger is energized to angularly move the arm, bringing the platen mounted on the arm to face the printer head and also bringing the recording paper pressure roller to face the recording paper drive roller. In this state, the print head is activated to perform printing, and the recording paper drive roller is rotated in the paper feed direction to perform paper feed.

With this prior art printer, however, if the validation paper is printed as set in front of the print head when the cut paper is also set in front of the print head, the cut paper is fed together with the validation paper with both papers caught by the recording paper pressure roller and the recording paper drive roller.

Further, since both the platen and the recording paper pressure roller are mounted on the swing arm, the swing arm would be relatively large in size and a large-size plunger-type solenoid is necessary for angular moving the large swing arm. This causes the entire paper feed mechanism larger in size and raises the cost for manufacture because of generally expensive plunger-type solenoid.

There is known another printer having a standard paper feed roller for feeding a standard paper and a validation paper feed roller for feeding a validation paper. In this conventional printer, as shown in FIGS. 19*a* and 19*b* of the accompanying drawings, a friction roller 69 is arranged in contact with the standard paper feed roller 68, and a validation paper feed roller 70 is arranged so as to move against and away from the paper feed roller 68. The standard paper P1 is fed as caught by the standard paper feed roller 68 and the friction roller 69. As to the validation paper P2, it is inserted between the standard paper feed roller 68 and the validation paper feed roller 70, whereupon the roller 70 is moved by a solenoid, etc., to press the validation paper P2 against the paper feed roller 68 for feeding.

In this conventional printer, if the validation paper P2 is set and fed when the standard paper P1 is set on the paper feed roller 68, the standard paper P1 is fed with the validation paper P2 since both the standard paper P1 and the validation paper P2 are caught by the standard paper feed roller 68 and the validation paper feed roller 70, resulting in waste of paper. Further, as the standard paper P1 is held between the paper feed roller 68 and the friction roller 69, the friction between the validation paper P2 and the standard paper P1 would be large to cause paper jamming.

SUMMARY OF THE INVENTION

It is therefore an object of this invention to provide a printer in which the validation paper feed is controlled by a single solenoid and only the validation paper feed can be performed even if the standard paper is set, thus reducing the number of parts to lower the cost of manufacture and realizing space saving.

According to a first aspect of the invention, the printer comprises: a rotatable shaft continuously driven in a direction of feeding a validation paper; a friction roller rotatably supported and extending parallel to said rotatable shaft; a validation paper feed roller mounted on said rotatable shaft for feeding the validation paper in cooperation with said friction roller, said validation roller having an arcuate circumferential surface for pressing the validation paper against said friction roller, and a chord flat surface apart from said friction roller when said validation roller is located at a predetermined rotational position; a ratchet wheel mounted on said rotatable shaft, said ratchet wheel having a positioning projection for determining an initial position of said validation roller, and a plurality of pawls for stopping said validation roller at a plurality of predetermined positions; a one-way clutch disposed between said rotatable shaft, said validation roller and said ratchet wheel for transmitting a torque of said rotatable shaft to said validation roller only in the direction of feeding the validation paper; an armature disposed in confronting relationship with said ratchet wheel and having an engage portion, said armature supported swingably between a first angular position in which said engage portion engages with said pawls and a second position in which said engage portion engages with said positioning projection; means for urging said engage portion of said armature to said first angular position; and means for angularly moving said engage portion of said armature to said second angular position; said locking portion of said armature being disengaged with said positioning projection when said engage portion is positioned in said first angular position.

The one-way clutch may be a spring clutch mounted around the validation paper feed roller and having an inside diameter smaller than an outside diameter of the validation paper feed roller. The spring clutch has one end to be engaged with the ratchet wheel and at the other end to be engaged with the validation paper feed roller.

The ratchet wheel may have a pawl portion and a larger-diameter portion integral with the pawl portion and larger in diameter than the pawl portion, the plurality of pawls extending from the pawl portion, and the positioning projection extending from the larger-diameter portion. The pawls of the ratchet may be arranged at all equidistant positions, except one position, around the pawl portion, and the positioning projection is arranged at a position corresponding to the pawl-omitted position.

According to a second aspect of the invention, the printer comprises: a friction roller shaft; a first friction roller rotatably mounted on said friction roller shaft for feeding a standard paper; a second friction roller mounted on said friction roller shaft to rotate independently of said first friction roller for feeding a validation paper; a first drive shaft extending parallel to said friction roller shaft; a second drive shaft extending parallel to said friction roller shaft; a standard paper feed roller mounted on said first drive shaft in contact with said first friction roller; and a validation paper feed roller mounted on said second drive shaft in contact with said second friction roller.

DETAILED DESCRIPTION OF THE PREFERRED EMBODIMENTS

Figure 1:
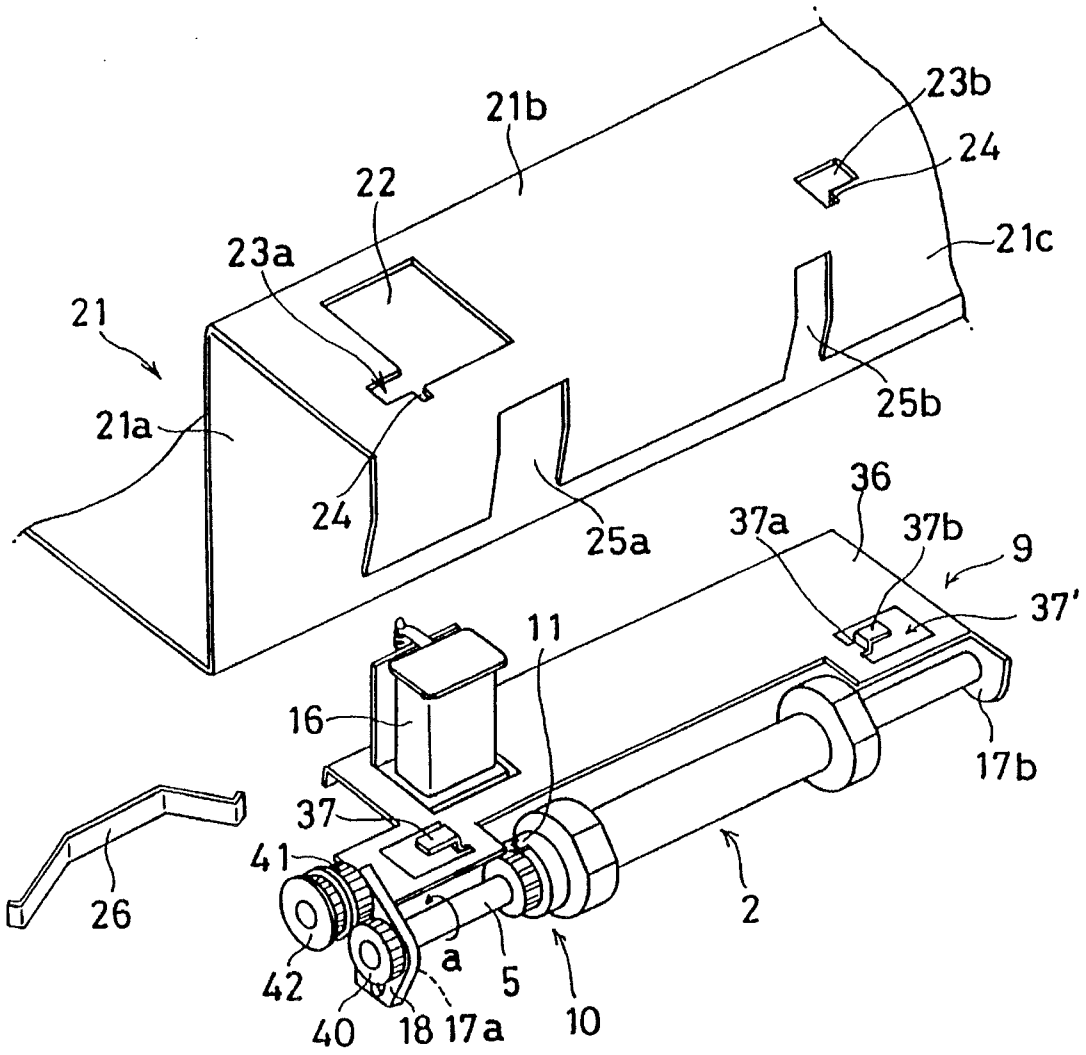
FIG. 1 is a perspective view showing a validation paper carriage and a frame cover of a printer according to one embodiment of this invention.

First of all, the validation paper feeding mechanism will be described with reference to FIGS. 1–5.

The validation paper feeding mechanism 9 comprises a validation sheet feed roller 2 for feeding the validation paper in cooperation with friction rollers 8*a* and 8*b*, a validation paper feed shaft 5 continuously driven during printing in the direction of paper feed, a ratchet wheel 10 having a multiplicity of pawls 38 and a positioning projection 11, a one-way clutch for selectively transmitting a torque of the validation paper feed shaft 5 to the validation paper feed roller 2, an armature 13 having an engage portion 14 engageable with the pawls 38 and the positioning projection 11 of the ratchet wheel 10, a tension spring 15 for urging the armature 13 to a position where the engaging portion 14 engages the pawls 38, and a solenoid 16 for swinging the armature 13 against an elastic force of the tension spring 15 to a position where the engaging portion 14 engages the positioning projection 11.

As shown in FIG. 1, a flat attachment plate 36 has on its upper surface attachment engaging members 37 and 37' and at opposite ends shaft support members 17*a* and 17*b* integral with the attachment plate 36. Each attachment support member 37 and 37' has a base portion 37*a* extending upwardly from the attachment plate 36, and a horizontal portion 37*b* extending horizontally from the base portion 37*a*. A gear support plate 18 for supporting gears 40 and 41 is attached to the outside of the shaft support member 17*a* of the attachment plate 36. The solenoid 16 is attached to the attachment plate 36, projecting on the upper side of the attachment plate 36.

The validation paper feed roller 5 is rotatably supported by the shaft support members 17*a* and 17*b*, and one end portion of the validation paper feed roller 5 extends through the shaft support member 17*a* and the gear support plate 18 and the gear 40 is fixed to a projected end of the validation paper feed roller 5. The gear 40 is continuously rotated in the direction of arrows a in FIGS. 1 and 4 by the gear 41 engaged with the gear 40, a pulley 42 provided coaxially with the gear 41, and a power transmission unit 30.

Figure 3:
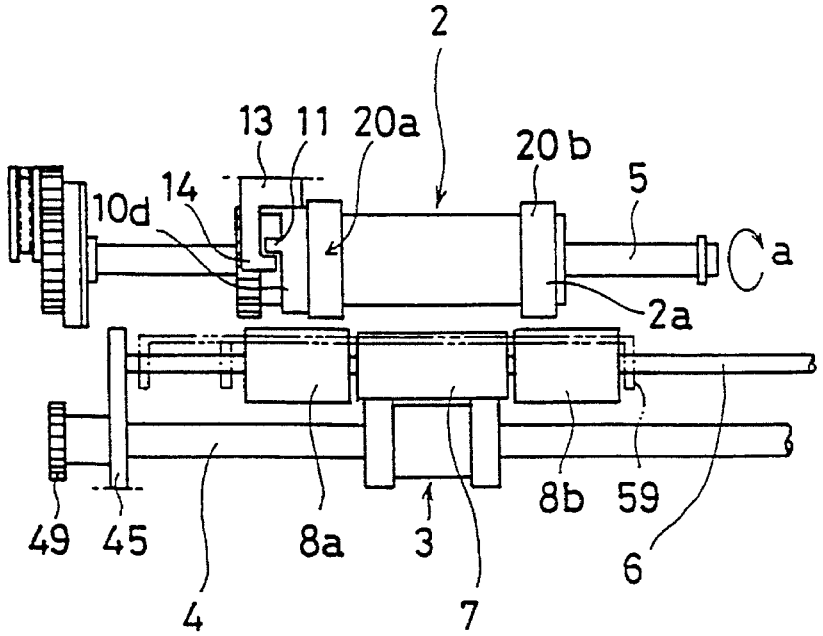
FIG. 3 is a plan view of FIG. 2, showing the validation paper feeding mechanism and a standard paper feeding mechanism.

As shown in FIG. 3, a friction roller shaft 6 extends in parallel to the validation paper feed roller 5, and a standard paper feed roller shaft 4 extends in parallel to the friction roller shaft 6. On the friction roller shaft 6, a friction roller 7 for the standard paper feed and friction rollers 8*a* and 8*b* for the validation paper feed are rotatably supported independently of one another. A standard paper feed roller 3 is mounted on the standard paper feed roller shaft 4, being pressed against the friction roller 7. Reference numeral 59 designates a paper guide.

Figure 5:
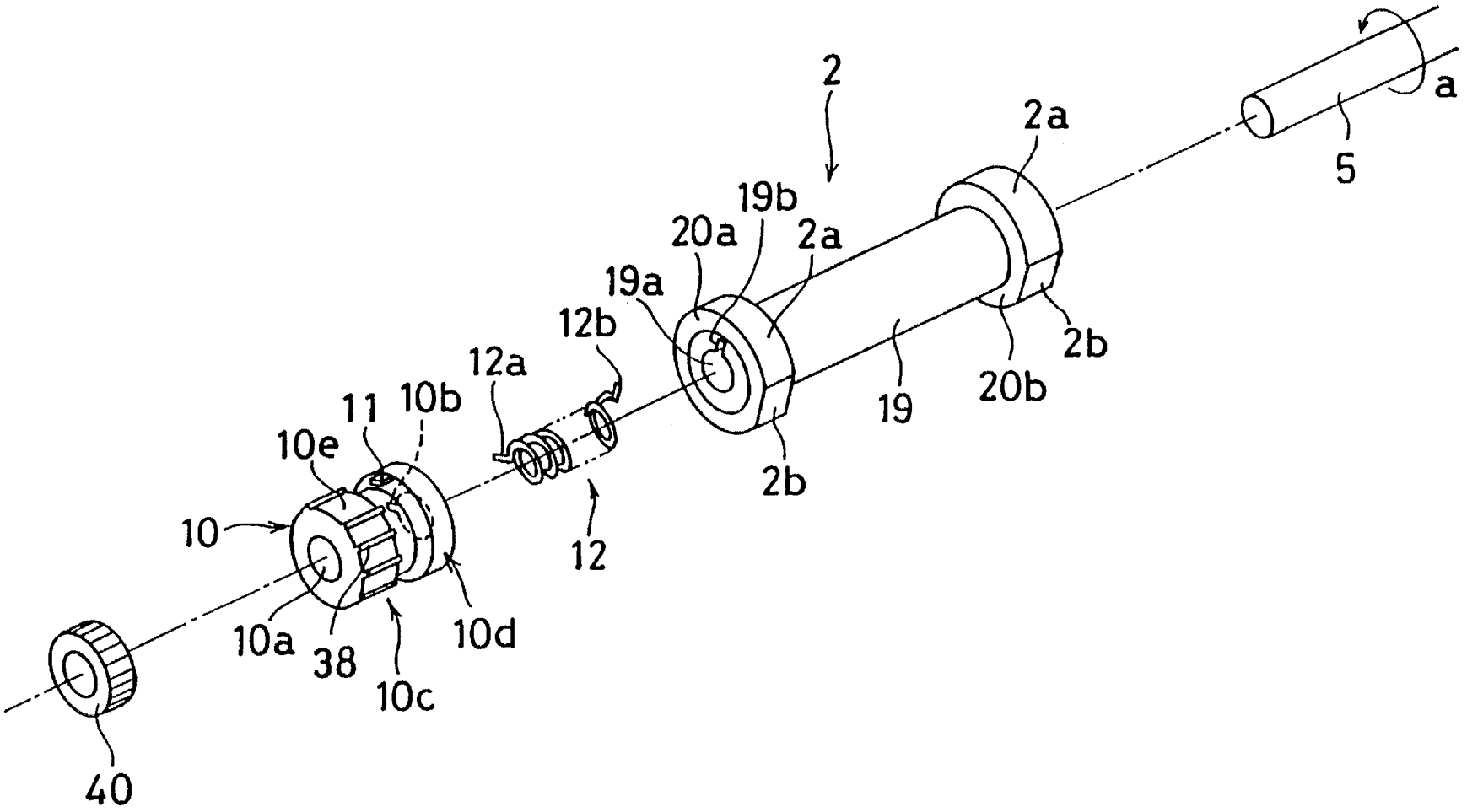
FIG. 5 is a perspective view showing the relationship between a validation paper feed shaft, a validation paper feed roller, a ratchet wheel and a one-way clutch.

On the validation paper feed shaft 5, a validation paper feed roller 2 is loosely fitted. As shown in FIG. 5, the validation paper feed roller 2 comprises a support tube 19, and rubber rings 20*a* and 20*b* fixed around opposite ends of the support tube 19. The support tube 19 has an insertion hole 19*a* through which the validation paper feed shaft 5 is inserted, and also has at one end a spring clutch engaging groove 19*b* extending radially from the insertion hole 19*a*. The rings 20*a* and 20*b* are identical in shape, and each has a cutout. The circumferential surface of each ring 20*a*, 20*b* are divided into an arcuate circumferential surface 2*a* and a chord flat surface 2*b*.

Figure 7:
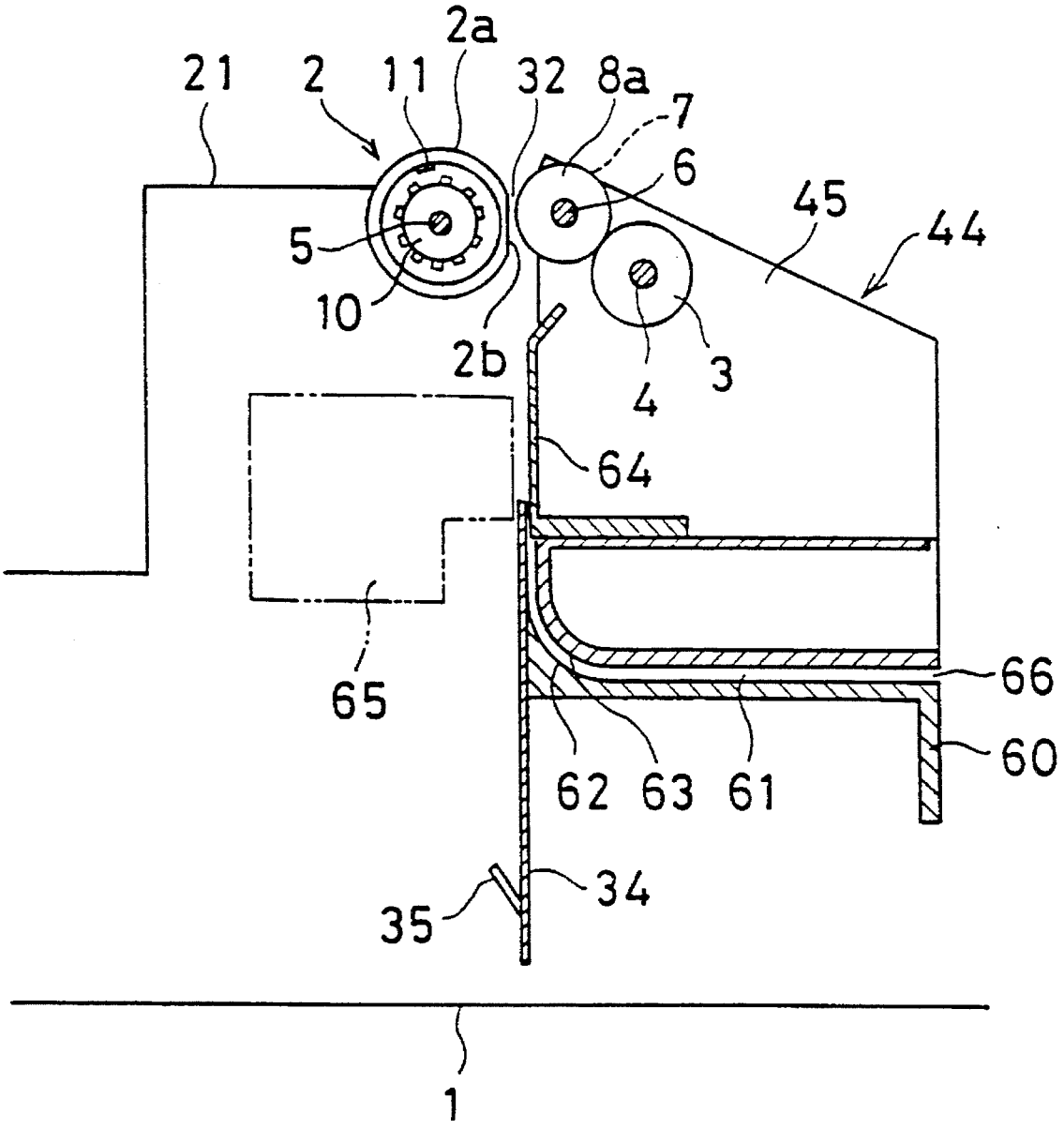
FIG. 7 is a schematic side view showing a part of the printer.
Figure 8:
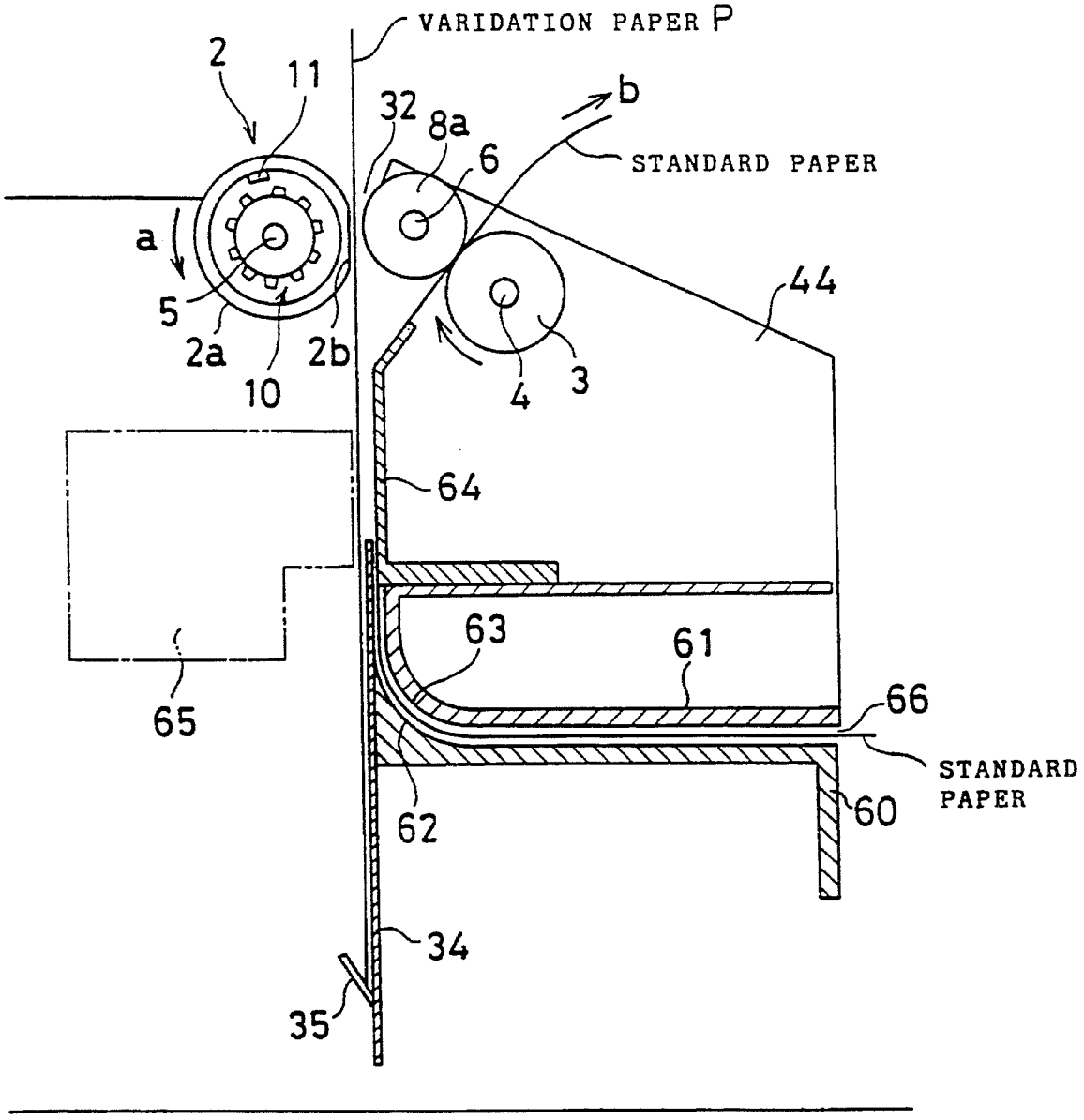
FIG. 8 is a schematic side view showing the manner in which the cut paper, the continuous paper and the validation paper are set in the printer.
Figure 10:
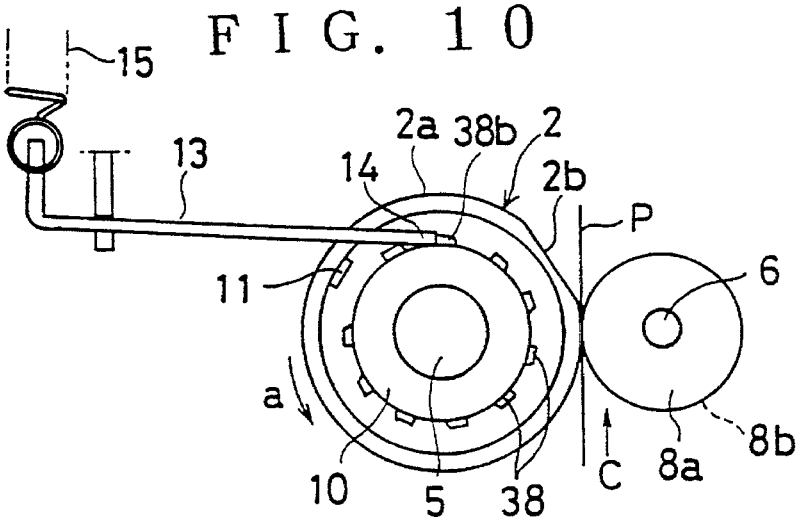

As shown in FIG. 3, the rings 20*a* and 20*b* are arranged in confronting relationship with the friction rollers 8*a* and 8*b*, respectively, and as shown in FIG. 10, the arcuate circumferential surfaces 2*a* of the rings 20*a* and 20*b* are pressed against the friction rollers 8*a* and 8*b*, respectively, to feed the validation paper. Further, as shown in FIGS. 7 and 8, the chord flat surfaces 2*b* of the validation paper feed roller 2 are separated from the friction rollers 8*a* and 8*b* when they face the friction rollers 8*a* and 8*b*. A validation paper insertion port 32 is formed between the chord flat surfaces 2*b* of the validation paper feed roller 2 and the corresponding friction rollers 8*a* and 8*b*.

On the validation paper feed shaft 5, the ratchet wheel 10 is loosely fitted. As shown in FIG. 5, the ratchet wheel 10 has a pawl portion 10*c* and a larger-diameter portion 10*d* integral with the pawl portion 10*c* and larger in diameter than the pawl portion 10*c*. The pawl portion 10*c* has a plurality of pawls 38 extending from its circumferential surface, and the larger-diameter portion 10*d* has a positioning projection 11 extending from its peripheral edge toward the pawl portion 10*c* for positioning the validation paper feed roller 2. The ratchet wheel 10 has an insertion hole 10*a* through which the validation paper feed shaft 5 is inserted and a spring clutch engaging groove 10*b* extending radially from the insertion hole 10*a*.

Figure 4:
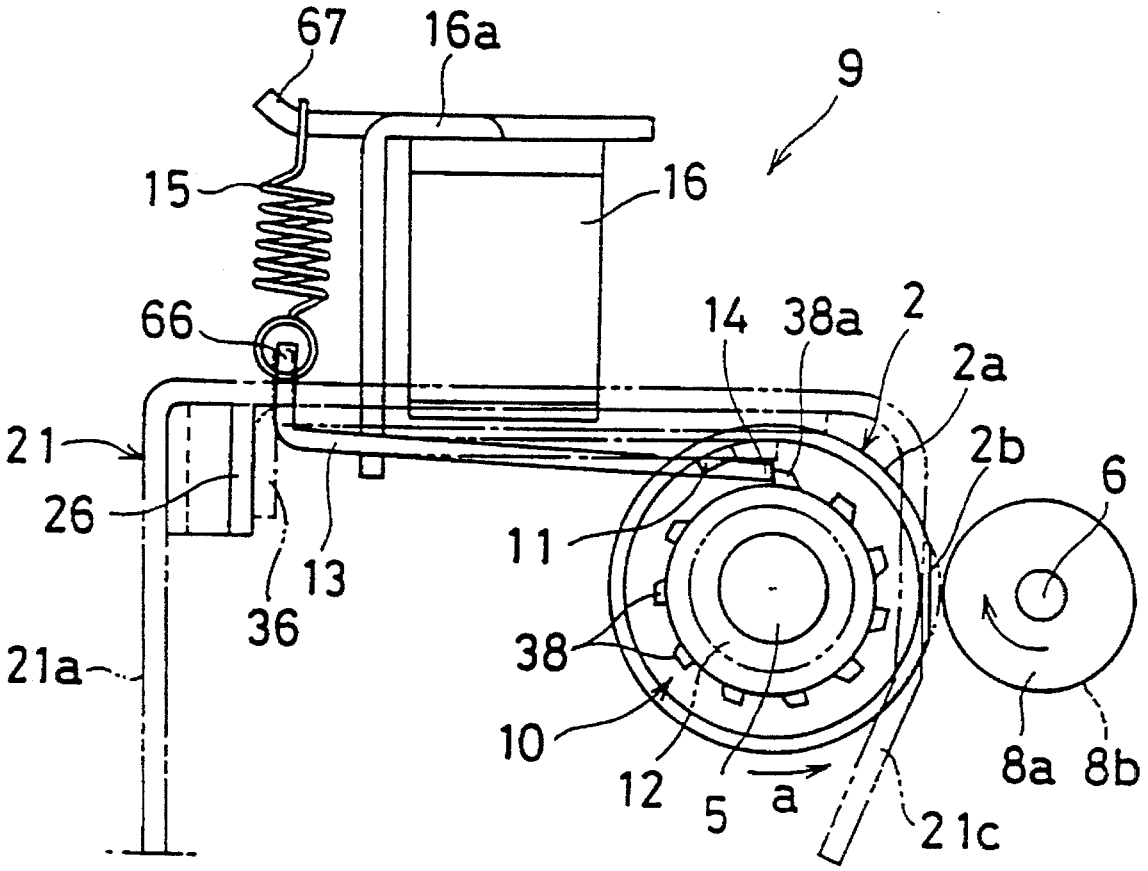
FIG. 4 is a side view of the validation paper feeding mechanism as shown in FIG. 1.

As shown in FIG. 4, the pawls 38 of the pawl portion 10*c* are provided around the circumferential surface of the pawl portion 10*c* and are arranged at all equidistant positions except one position. In this embodiment, the pawls 38 are arranged at ten of eleven equally divided circumferential positions. The pawls may be arranged at all equidistant positions except two or more positions. The positioning projection 11 of the larger-diameter portion 10*d* is located at a position corresponding to the position where one pawl is omitted in the pawl portion 10*c*.

The validation paper feed roller 2 and the ratchet wheel 10 are connected to the validation paper feed shaft 5 by a one-way clutch.

As shown in FIG. 5, the one-way clutch comprises a spring clutch 12 mounted around the validation paper feed shaft 5 in this embodiment. The spring clutch 12 has a pair of connecting portions 12*a* and 12*b* extending radially outwardly from opposite ends. The spring clutch 12 has an inside diameter smaller, in its original form before assembled, than the outside diameter of the validation paper feed shaft 5. The spring clutch 12 fitted around the validation paper feed shaft 5 is normally stuck to the shaft 5 under the elastic force thereof to rotate with the shaft 5, thus transmitting a torque of the shaft 5 to the validation paper feed roller 2. Assuming that one of the connecting portions 12*a* and 12*b* of the spring clutch 12 is fixed, the inside diameter of the spring clutch 12 will expand if the direction of rotation of the shaft 5 is opposite to the winding direction of the spring clutch 12, so that the rotation of the shaft 5 will not be transmitted to the validation paper feed roller 2. As shown in FIG. 5, since the spring clutch 12 is wound clockwise from one connecting portion 12*a* to the other connecting portion 12*b* and the validation paper feed shaft 5 is rotated in the direction of an arrow a, the inside diameter of the spring clutch 12 expands so that the validation paper feed shaft 5 is rotated idly when the connecting portion 12*a* is fixed.

Thus, the ratchet wheel 10 and the validation paper feed roller 2 are mutually connected by the one-way clutch 12, and the ratchet wheel 10 and the validation paper feed roller 2 are selectively connected with the validation paper feed shaft 5. The rotation of the validation paper feed shaft 5 is transmitted to the validation paper feed roller 2 only in the direction of feeding the validation paper.

As shown in FIG. 4, the armature 13 engageable with the pawls 38 and the positioning projection 5 of the ratchet wheel 10 is in the form of a metal plate having an upwardly bent spring engaging projection 66 at its rear end. As shown in FIG. 3, the engage portion 14 of the armature 13 is extending forwardly from one side and an end thereof is projecting towards the other side.

The solenoid 16 for driving the armature 13 is situated in confronting relationship with the upper surface of the armature 13. The armature 13 is pivotally supported at a position near its rear end by the lower portion of a yoke 16*a* of the solenoid 16, as shown in FIG. 4. A tension spring 15 is hanged between the spring engaging projection 66 of the armature 13 and the spring engaging projection 67 extending from the upper portion of the solenoid yoke 16*a*. While the solenoid 16 is not excited, the front end of the engage portion 14 of the armature 13 is brought into engagement with the pawls 38 of the ratchet wheel 10 under the elastic force of the tension spring 15.

Figure 2:
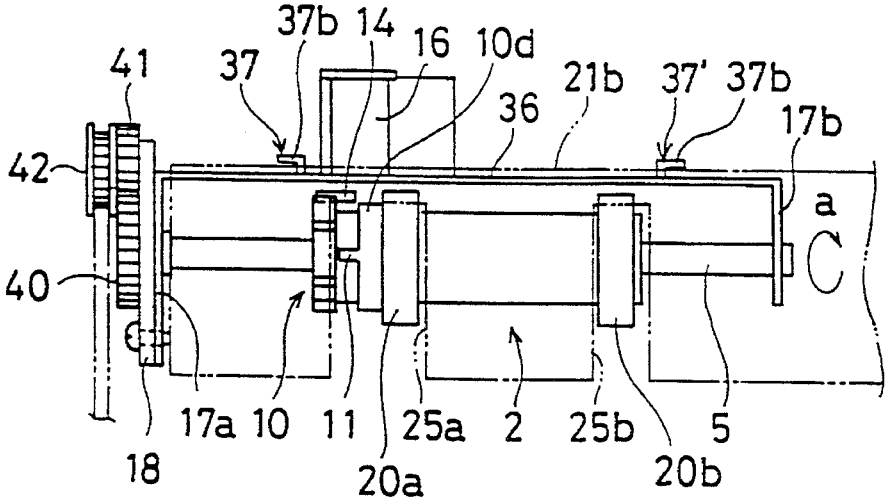
FIG. 2 is a front view of the validation paper feeding mechanism as shown in FIG. 1.
Figure 11:
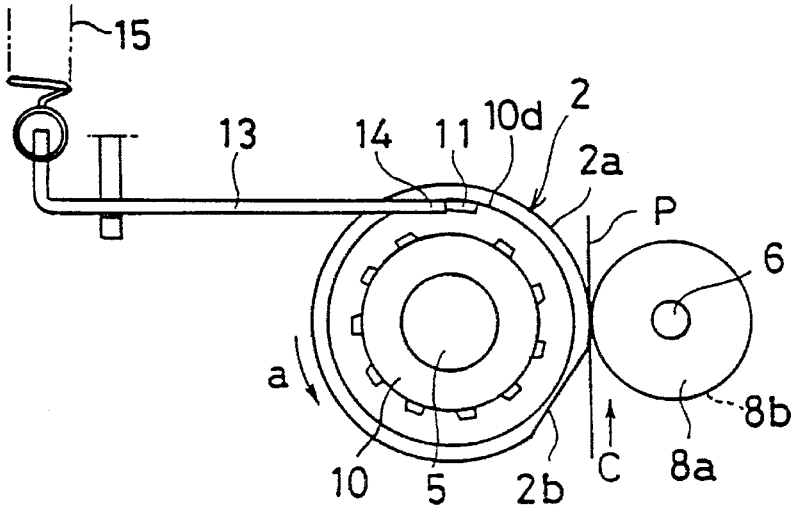
FIGS. 11 and 12 illustrates the engaging relationship between the ratchet wheel and the armature when setting an initial position of the validation roller.

Further, the engage portion 14 of the armature 13 is engageable with the positioning projection 11 on the larger-diameter section 10*d* of the ratchet wheel 10, as shown in FIGS. 2 and 3. When the solenoid 16 is excited to swing the armature upwardly as shown in FIG. 11, the armature 13 is brought into engagement with the positioning projection 11.

As shown in FIG. 1, the validation paper feeding mechanism 9 is covered with a frame cover 21. The frame cover 21 composed of an upright plate 21*a* extending transversely of the printer, a ceiling plate 21*b* continuously extending forwardly from the upper portion of the upright plate 21*a*, and a suspending plate 21*c* hanging from the front portion of the ceiling plate 21*b*, integrally formed with one another.

The ceiling plate 21*b* has an aperture 22 through which the solenoid 16 is to be inserted, the solenoid 16 being attached to and projecting from the upper surface of the attachment plate 36 of the validation paper feeding mechanism 9. The ceiling plate 21*b* also has engaging holes 23*a* and 23*b* and an engaging groove communicating with the engaging holes 23*a* and 23*b* for engaging the attachment engaging members 37 and 37' of the attachment plate 36, the engaging hole 23*a* communicating with the aperture 22.

The suspending plate 21*c* is bent slightly inwardly from a central portion to a lower edge and has two generally rectangular cutouts 25*a* and 25*b* in the lower edge portion, the cutout 25*a* being larger in width than the cutout 25*b*.

The frame cover 21 is mounted around the validation paper feeding mechanism 9 in the following manner. The solenoid 16 attached to the attachment plate 36 is inserted through the aperture 22 of the frame cover 21 from the lower side, the two engaging members 37 and 37' of the attachment plate 36 are inserted through the engaging holes 23*a* and 23*b*, respectively, of the ceiling plate 21*b*.

Then, the attachment plate 36 is slid forwardly toward the suspending plate 21*c* to insert the base portions 37*a* of the attachment engaging members 37 and 37' into the respective engaging grooves 24 of the engaging holes 23*a* and 23*b*. The horizontal positions 37*b* of the attachment engaging members 37 and 37' are thereby supported on the upper surface of the ceiling plate 21*b*, as shown in FIG. 2. Then, a leaf spring 26 is placed between the upright plate 21*a* of the frame cover 21 and the attachment plate 36 to push the attachment plate 36 toward the suspending plate 21*c* so that the attachment plate 36 is positioned stably.

Thus, as shown in FIGS. 2 and 4, the rings 20*a* and 20*b* of the validation paper feed roller 20 are inserted in the cutouts 25*a* and 25*b*, respectively, of the suspending plate 21*c* in such a manner that the circumferential surface of each ring 20*a* and 20*b* is exposed from the suspending plate 21*c*.

Figure 6:
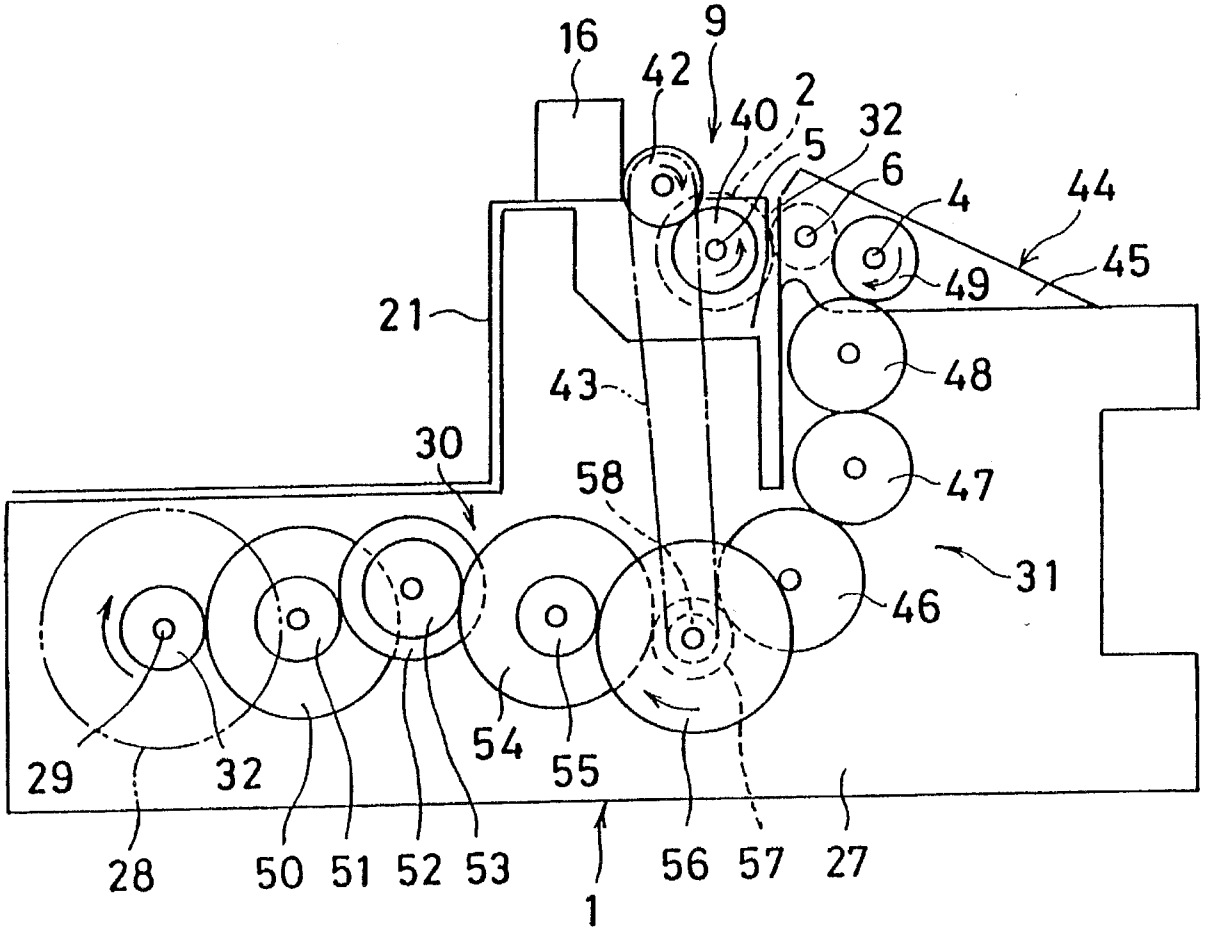
FIG. 6 is a schematic side view of a drive force transmission unit of the printer.

The driving force transmitting mechanism will now be described with reference to FIG. 6. In FIG. 6, a drive motor is fixed on a side frame 27. A power transmission unit 30 is composed of a gear train of gears 50–57 meshing with a driving gear 32 fixed to a motor shaft 29, a pulley 58 coaxial with the gear 57, a pulley 42 rotatably supported by the gear support plate 18, and a timing belt 43 wound around the two pulleys 42 and 58. A standard paper feed power transmission unit 31 is composed of a gear train 46–48 engaging with the gear 56, and a gear 49 fixed to the standard paper feed roller shaft 4. The individual gears 50–57, the pulley 58 and the individual gears 46–48 are rotatably supported on the side frame 27. The frame cover 21 as shown in FIG. 1 is mounted on the upper surface of the side frame 27 of a printer body 1.

As shown in FIG. 6, between the upper portions of opposite side plates 45 and 45 of a standard paper feeding mechanism body 44, the friction roller shaft 6 is rotatably supported and the standard paper feed roller shaft 4 is rotatably supported in parallel to the friction roller shaft 6. On the friction roller shaft 6, as shown in FIG. 3, the friction rollers 8*a* and 8*b* for the validation paper feed and the friction roller 7 for the standard paper feed is rotatably supported independently of one another.

FIG. 7 is a schematic side cross-sectional view showing a paper traveling path. The printer body 1 has two side frames 27, shown in FIG. 6, and a base 60 fixed to and disposed between the side frames 27. The validation paper feeding mechanism 9 is disposed on the upper side of the side frames 27. The standard paper feeding mechanism body 44 is disposed upwardly of the base 60, supported between the side frames 27. A standard paper traveling path 61 is defined between the upper surface of the base 60 and the lower surface of the standard paper feeding mechanism body 44. A paper guide portion 62 having a hyperbolical surface in cross section is formed at the rear end of the base 60. At the lower portion of the standard paper feeding mechanism body 44 at the rear end thereof, an arcuate peripheral portion 63 is formed with a small gap along the paper guide portion 62 formed on the base 60.

A platen plate 64 is disposed at the rear surface of the standard paper feeding mechanism body 44, and a print head 65 is disposed movably along the surface of the platen plate 64. A paper guide plate 34 is vertically supported on the printer body 1 near the lower edge of the platen plate 64. The upper edge of the front surface of the paper guide plate 34 is in close contact with the platen plate 64, and on the rear surface of the paper guide plate 34 near the lower edge thereof, a plurality of obliquely upwardly bent validation paper stoppers 35 are formed transversely of the paper guide plate 34.

As shown in FIG. 8, when the standard paper is inserted into the paper traveling path from the paper insertion port 66, it is bent upwardly along the paper guide portion 62 of the base 60, then passes between the paper guide plate 34 and the platen plate 64 and is then brought into close contact with the surface of the platen plate 64 guided by the paper guide plate 34. Then the standard paper is fed in the predetermined feed direction along the platen plate 64 as nipped between the standard paper feed roller 3 and the friction roller 7.

When the chord flat surfaces 2*b* of the rings 20*a* and 20*b* of the validation paper feed roller 2 take a position facing the friction rollers 8*a* and 8*b*, a validation paper insertion port 32 is formed so that the validation paper P can be inserted downwardly from the validation paper insertion port 32. The validation paper P passes between the platen plate 64 and the print head 65 and then moves downwardly along the front surface of the paper guide plate 34 until the lower end of the paper P abuts on the validation paper stoppers 35 to defining a position of the validation paper P.

The operation of the validation paper feeding mechanism will now be described.

First of all, how to set up the initial position of the validation paper feed roller 2 will be explained. The initial position of the validation paper feed roller 2 is set while the validation paper is not inserted in the validation paper insertion port 32 of FIG. 7.

As the drive motor 28 of FIG. 6 is rotated, the validation paper feed shaft 5 is rotated in the direction of an arrow a via the driving gear 32, the power transmission unit 30, the timing belt 43, the pulley 42 and the gears 41 and 40 of FIG. 2.

As shown in FIG. 4, while the solenoid 16 is not excited, the armature 13 is urged by the elastic force of the tension spring 15 so that the engage portion 14 of the distal end of the armature 13 is pressed against the circumferential surface of the ratchet wheel 10 to engage any of the pawls 38 of the ratchet wheel 10. In this state, the connecting portion 12*a* of the spring clutch 12 of FIG. 5 is fixed, and the inside diameter of the spring clutch 12 is expanded so that the validation paper feed shaft 5 idles and its torque is not transmitted to the validation paper feed roller 2.

Figure 13:
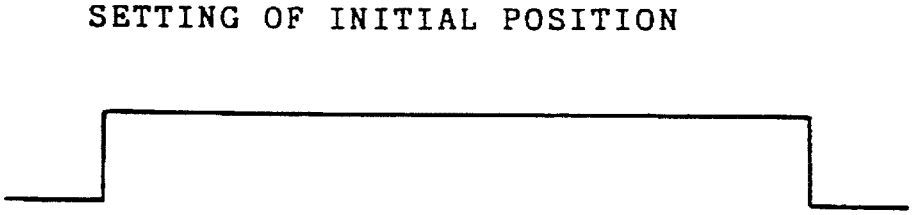
FIG. 13 is a timing chart showing the action of a solenoid when setting the initial position of the validation roller.

In order to set the initial position of the validation paper feed roller 2, the solenoid 16 is excited for more than a time needed to one revolution of the validation paper feed shaft 5, as shown in the timing chart of FIG. 13. As the solenoid 16 is excited, the armature 13 is attracted by the solenoid 16 to swing upwardly so that the engagement of the locking portion 14 with the pawl 38 will be released. The inside diameter of the spring clutch 12 thereby decreases so that the validation paper feed shaft 5, the ratchet wheel 10 and the validation paper feed roller 2 are rotated as a unit in the direction of arrow a.

While the solenoid 16 is excited, the locking portion 14 is held in the upper position, during which the ratchet wheel 10 is rotated in the direction of arrow a. With continuous rotation of the ratchet wheel 10, as shown in FIG. 11, the distal end of the locking portion 14 abuts on the positioning projection 11 on the larger-diameter portion 10 of the ratchet wheel 10, so that the inside diameter of the spring clutch 12 increases again to stop the rotation of the validation paper feed roller 2, causing the validation paper feed shaft 5 to idle.

When the excitation of the solenoid 16 terminates after the lapse of more than the time needed to one revolution of the validation paper feed shaft 5, the locking portion 14 of the distal end of the armature 13 is again urged toward the pawl portion 10*c* of the ratchet wheel 10 to contact the circumferential surface 10*e* of the pawl portion 10*c*.

Since the positioning projection 11 on the larger-diameter portion 10*d* is located at a position corresponding to the pawl-omitted position of the pawl portion 10*c*, the engage portion 14 comes into contact with the pawl-omitted circumferential surface 10*e* of the ratchet wheel 10. In this state, the validation paper feed shaft 5, the ratchet wheel 10 and the validation paper feed roller 2 are rotated as a unit in the direction of arrow a, so that the front of the engage portion 14 comes into contact with the pawl 38*a* for defining the initial position of the validation paper feed roller 2, thus causing the ratchet wheel 10 and validation paper feed roller 2 to stop at the initial position shown in FIGS. 4 and 7.

In the initial position of FIGS. 4 and 7, the chord flat surfaces 2*b* of the rings 20*a* and 20*b* of the validation paper feed roller 2 take a position facing the friction rollers 8*a* and 8*b*, respectively to form the validation paper insertion port 32. In this initial position, as shown in FIG. 8, the validation paper P is inserted into the validation paper insertion port 32 until it abuts on the validation paper stops 35, thus completing the setting the validation paper P for printing.

The feeding of the validation paper will now be described.

Figure 14:
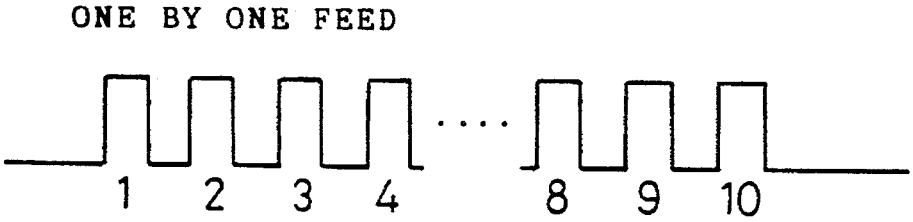
FIG. 14 is a timing chart showing the action of the solenoid during the validation paper feed.

For feeding the validation paper, with the validation paper feed roller 2 of FIG. 4 set in the initial position, the solenoid 16 is intermittently energized periodically and repeatedly for ten pawls 38 of the ratchet wheel 10 one by one to feed the paper, as shown in timing chart of FIG. 14.

Figure 9:
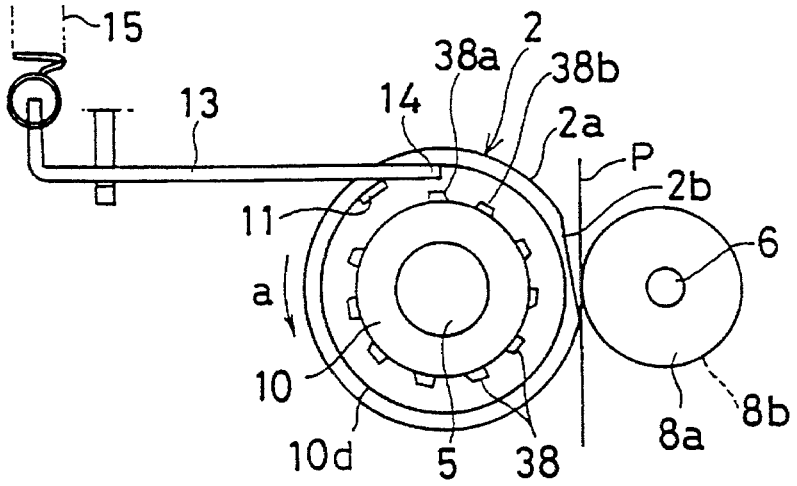
FIGS. 9 and 10 illustrate the engaging relationship between the ratchet wheel and an armature during the validation paper feed operation.

As shown in FIG. 9, as the solenoid 16 is energized, the armature 13 is angularly moved to the upper position as attracted by the solenoid 16, thus releasing the engagement between the locking portion 14 and the pawl 38*a* so that the validation paper feed shaft 5, the ratchet wheel 10 and the validation paper feed roller 2 are rotated as a unit in the direction of arrow a.

Since the solenoid 16 is unenergized in a short time after energized, the locking portion 14 of the distal end of the armature 13 is again urged against the pawl portion 10*c* of the ratchet wheel 10 by the elastic force of the tension spring 15 to contact the circumferential surface of the pawl portion 10*c*. As the validation paper feed roller 2 and the ratchet wheel 10 are rotated in the direction of arrow a, the distal end of the locking portion 14 engages with the pawl 38*b* next to the pawl 38*a*, as shown in FIG. 10.

In this state, as the validation paper feed roller 2 has been rotated, the chord flat surface 2*b* of the validation paper feed roller 2 leaves the position facing the circumferential surfaces of the friction rollers 8*a* and 8*b*, and the arcuate circumferential surfaces 2*a* of the validation paper feed roller 2 are angularly moved to the position facing and contacting the circumferential surfaces of the friction rollers 8*a* and 8*b*. Therefore, the validation paper P is caught between the arcuate circumferential surfaces 2*a* of the validation paper feed roller 2 and the circumferential surfaces of the friction rollers 8*a* and 8*b*.

Further, as unenergization of the solenoid 16 is periodically repeated, the validation paper feed roller 2 and the ratchet wheel 10 are rotated as a unit with the validation paper feed shaft 5 at a predetermined pitch corresponding to distance between the individual pawls 38, so that the validation paper P is fed in the paper feed direction indicated by an arrow c.

Meanwhile, the printing head 65 shown in FIG. 8 is moved horizontally along the platen plate 64 to perform multi-line validation printing.

Figure 12:
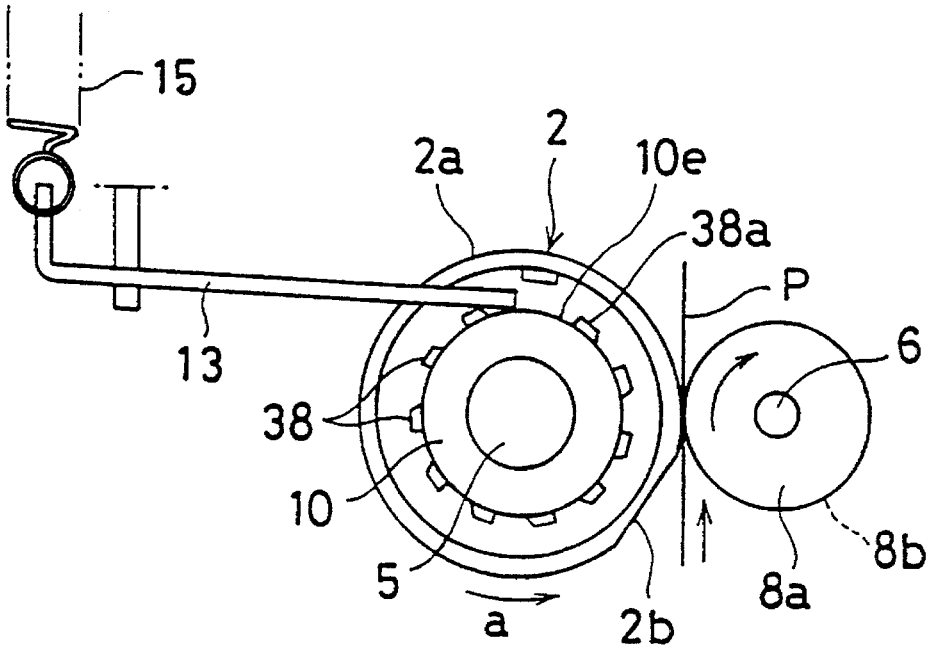

As unenergization of the solenoid 16 is repeated ten times, the engage portion 14 of the armature 13 is brought into contact with the pawl-omitted circumferential surface 10*e* of the ratchet wheel 10, as shown in FIG. 12. Then, the validation paper feed shaft 5, the ratchet wheel 10 and the validation paper feed roller 2 are rotated as a unit in the direction of arrow a so that the distal end of the engage portion 14 comes into contact with the pawl 38*a*, which defines the initial position of the validation paper feed roller 2, thus causing the roller 2 to stop in the initial position again. In this state, the chord flat surfaces 2*b* of the validation paper feed roller 2 face the friction rollers 8*a* and 8*b*, respectively, to form the validation paper insertion port 32, so that the printed validation paper can be picked up from the validation paper insertion port 32.

Figure 15:
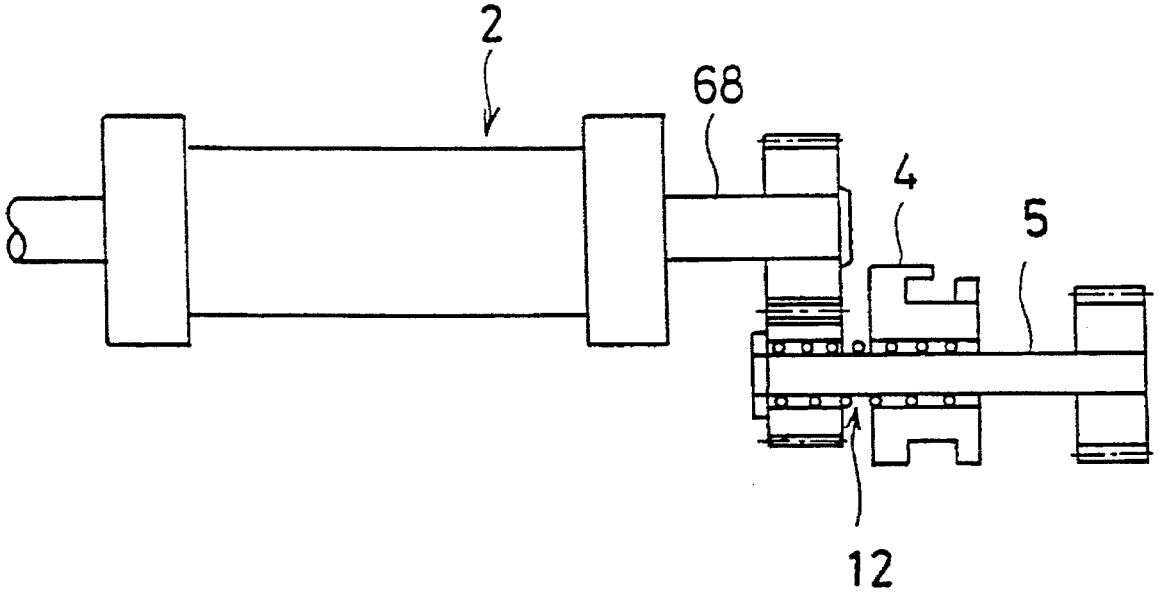
FIG. 15 is a cross-sectional view showing a modified validation paper carriage according to another embodiment.

As shown in FIG. 15, the validation paper feed roller 2 may be mounted on an auxiliary shaft 68 parallel to the validation paper feed shaft 5. In this case, the validation paper feed shaft 5 and the auxiliary shaft 68 are connected with one another via gears and a one-way clutch (spring clutch) 12. The one-way clutch 12 transmits the torque of the validation paper feed shaft 5 to the auxiliary shaft 68 only in the direction in which the validation paper feed roller 2 feeds the paper.

With the rotation of the drive motor 28 of FIG. 6, the validation paper feed shaft 5 is rotated in the paper feed direction via the power transmission unit 30, the pulley 42, and the gears 41 and 40 of FIG. 8. At the same time, the standard paper feed shaft 4 is rotated in the paper feed direction via the power transmission units 30 and 31.

Therefore, when feeding the validation paper by the validation paper feed roller 2 mounted on the validation paper feed shaft 5, it is necessary to prevent the standard paper from being fed by the standard paper feed roller 3 mounted on the standard paper feed shaft 4.

Figure 16:
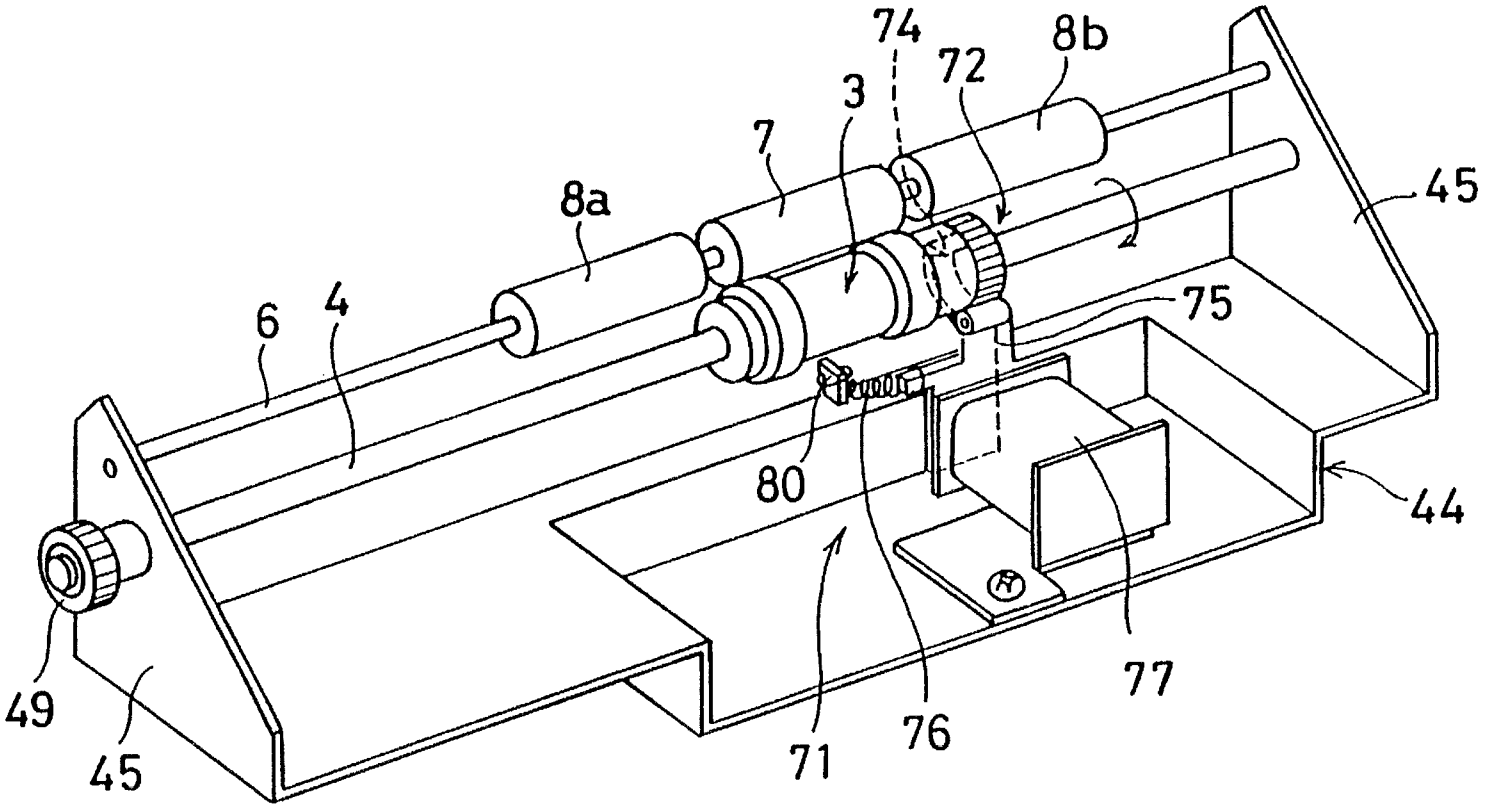
FIG. 16 is a perspective view showing a modified standard paper feeding mechanism according to still another embodiment.
Figure 17:
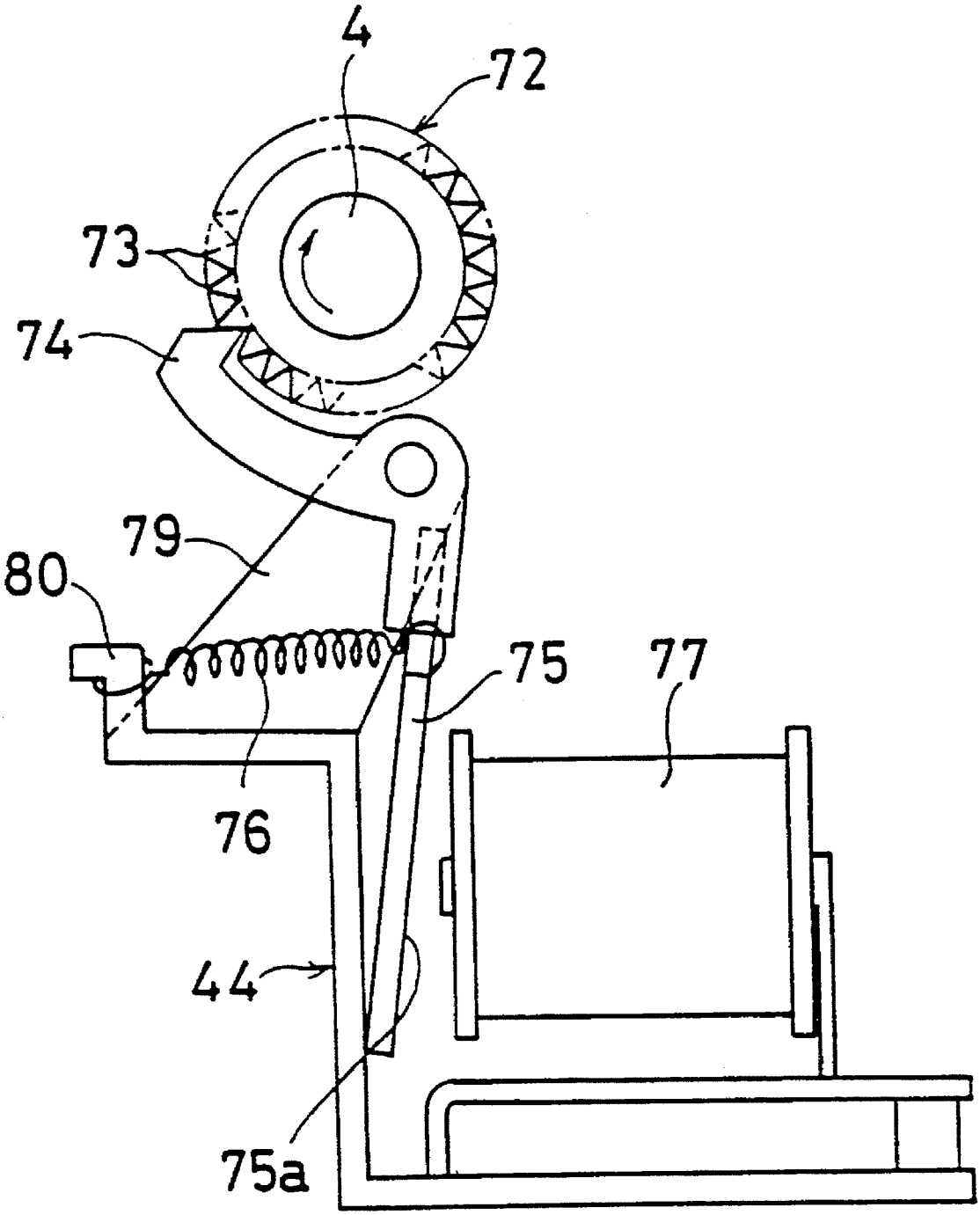
FIG. 17 is a side view showing a standard paper feed suspending unit.
Figure 18:
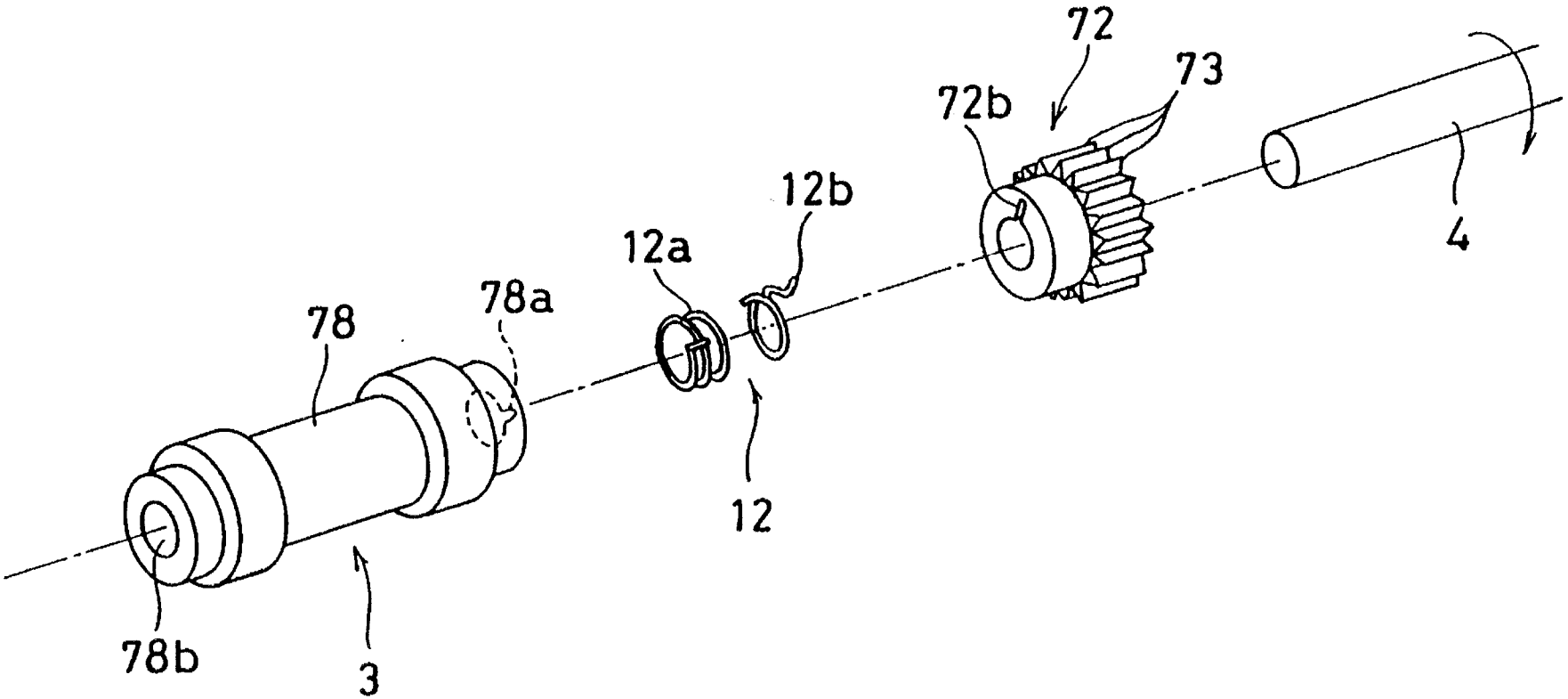
FIG. 18 is a fragmentary perspective view of FIG. 17.
Figure 19A:
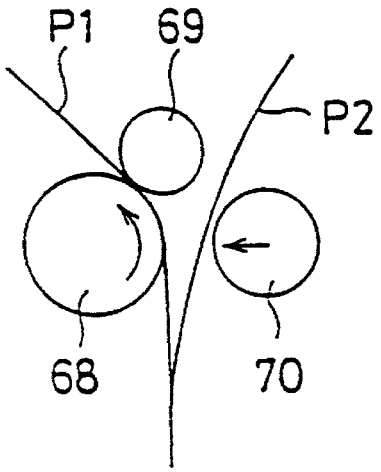
FIGS. 19*a–b* illustrate the manner in which the standard paper and the validation paper are fed in the conventional printer.
Figure 19B:
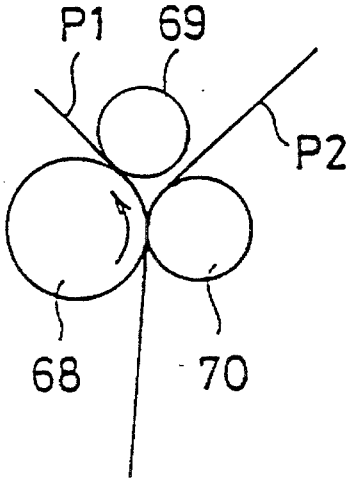

FIGS. 16–18 show a modified standard paper feeding mechanism according to a second embodiment. The standard paper feeding mechanism includes a standard paper feed suspending unit 71. The standard paper feed suspending unit 71 comprises a ratchet wheel 72, a one-way clutch 12, a standard paper feed roller 3, an armature 75 having an engage portion 74 engageable with a pawl portion 73 of the ratchet wheel 72, a tension spring 76 urging the engage portion 74 of the armature 75 against the pawl portion 73 of the ratchet wheel 72, and a second solenoid 77 for releasing the engage portion 74 of the armature 75 from the pawl portion 73 of the ratchet wheel 74 against the elastic force of the tension spring 76.

As shown in FIG. 18, the standard paper feed roller 3 and the ratchet wheel 72 are mounted on the standard paper feed shaft 4 via the one-way clutch 12 identical with the spring clutch 12 of FIG. 6. Since the way of attaching the standard paper feed roller 3, the ratchet wheel 72 and the one-way clutch 12 to the standard paper feed shaft 4 is similar to the way of attaching the ratchet wheel 10, the validation paper feed roller 2 and the one-way clutch 12 to the validation paper feed shaft 5, a description thereof is omitted here. Reference numeral 78 designates a support tube of the standard paper feed roller 3, and 78*a* designates a spring clutch engaging groove communicating with a shaft insertion hole 78*b* of the support tube 78.

In FIGS. 16 and 17, a central portion of the armature 75 is pivotally supported on a shaft support plates 79 projecting from the standard paper feeding mechanism body 44, with the engage portion 74 facing the pawl portion 73 of the ratchet wheel 72. The engage portion 74 is urged by the elastic force of the tension spring 76 to engage the pawl portion 73 of the ratchet wheel 72. The tension spring 76 is connected at one end to the armature 75 and at the other end to a projection 80 of the standard paper feed mechanism body 44 near the rear end thereof. The solenoid 77 is mounted on the standard paper feeding mechanism body 44, confronting the attraction surface 75*a* positioned from the central portion to the lower portion of the armature 75.

While the validation paper is fed, the engage portion 74 of the armature 75 engages the pawl portion 73 of the ratchet wheel 72 by the elastic force of the tension spring 76 and the ratchet wheel 72 is stopped, so that the one-way clutch 12 spreads to allow the standard paper feed shaft 4 to rotate idle. Thus, the rotation of the standard paper feed roller 3 is stopped to suspend the feeding of the standard paper.

For feeding only the standard paper, the armature 75 is energized. Upon energization of the armature 75, the attraction surface of the armature 75 is attracted by the second solenoid 77 so that the armature 5 swings against the elastic force of the tension spring 76 to release the engage portion 74 from the pawl portion 73 of the ratchet wheel 72. Thus, the second ratchet wheel 72 and the standard paper feed roller 3 rotate together with the standard paper feed shaft 4.

According to this invention, since the feeding of the validation paper can be controlled by a single solenoid and the validation paper feeding mechanism comprises the solenoid, the armature, the spring clutch, the ratchet wheel and the validation roller, it is possible to reduce the cost of production and to realize space saving as compared the conventional paper feeding mechanism in which the movable arm is angularly moved by a plunger-type solenoid. Further, since the standard paper, i.e. cut or continuous paper, and the validation paper are fed independently of each other, it is possible to feed solely the validation paper even when the cut or continuous paper is set for printing.

What is claimed is:

1. A printer with a validation paper feeding mechanism, comprising:

a rotatable shaft continuously driven in a direction of feeding a validation paper;

a friction roller rotatably supported and extending parallel to said rotatable shaft;

a validation paper feed roller mounted on said rotatable shaft for feeding the validation paper in cooperation with said friction roller, said validation roller having an arcuate circumferential surface for pressing the validation paper against said friction roller, and a chord flat surface apart from said friction roller when said validation roller is located at a predetermined rotational position;

a ratchet wheel mounted on said rotatable shaft, said ratchet wheel having a positioning projection for determining an initial position of said validation roller, and a plurality of pawls for stopping said validation roller at a plurality of predetermined positions;

a one-way clutch disposed between said rotatable shaft, said validation roller and said ratchet wheel for transmitting a torque of said rotatable shaft to said validation roller only in the direction of feeding the validation paper;

an armature disposed in confronting relationship with said ratchet wheel and having an engage portion, said armature supported swingably between a first angular position in which said engage portion engages with said pawls and a second position in which said engage portion engages with said positioning projection;

means for urging said engage portion of said armature to said first angular position; and means for angularly moving said engage portion of said armature to said second angular position;

said locking portion of said armature being disengaged with said positioning projection when said engage portion is positioned in said first angular position.

2. A printer with a validation paper feeding mechanism according to claim 1, wherein said one-way clutch comprises a spring clutch mounted around said validation paper feed roller and having an inside diameter smaller than an outside diameter of said validation paper feed roller, said spring clutch having one end engaged with said ratchet wheel and the other end engaged with said validation paper feed roller.

3. A printer equipped with a validation paper feeding mechanism according to claim 1, wherein said ratchet wheel has a pawl portion and a larger-diameter portion integral with said pawl portion and larger in diameter than said pawl portion, said plurality of pawls extending from said pawl portion and said positioning projection extending from said larger-diameter portion.

4. A printer with a validation paper feeding mechanism according to claim 3, wherein said pawls of said ratchet wheel are arranged at all equidistant positions in a circumference of said pawl portion except at least one position, and said positioning projection is formed at a position corresponding to the position where a pawl is omitted in the circumference of said pawl portion.

5. A printer with a validation paper feeding mechanism, comprising:

a friction roller shaft;

a first friction roller rotatably mounted on said friction roller shaft for feeding a standard paper;

a second friction roller mounted on said friction roller shaft to rotate independently of said first friction roller for feeding a validation paper;

a first drive shaft extending parallel to said friction roller shaft;

a second drive shaft extending parallel to said friction roller shaft;

a standard paper feed roller mounted on said first drive shaft in contact with said first friction roller; and a validation paper feed roller mounted on said second drive shaft in contact with said second friction roller.

* * * * *